United States Patent [19]

Burdine

[11] Patent Number: 4,561,479

[45] Date of Patent: Dec. 31, 1985

[54] MECHANICAL WOOD SPLITTER

[76] Inventor: Charles M. Burdine, P.O. Box 182, Magnolia, Ark. 71753

[21] Appl. No.: 596,716

[22] Filed: Apr. 4, 1984

[51] Int. Cl.[4] ..... B27L 7/00

[52] U.S. Cl. ..... 144/193 B; 144/193 R; 144/193 K; 173/84; 269/157; 269/238; 269/258; 269/268; 269/287

[58] Field of Search ..... 144/193 R, 193 B, 193 K, 144/366; 173/84, 85, 89; 269/157, 158, 258, 238, 268, 287; 52/120

[56] References Cited

U.S. PATENT DOCUMENTS

| | | | |
|---|---|---|---|
| 508,221 | 11/1893 | Hill | 144/193 A |
| 858,322 | 6/1907 | Bandimere | 173/84 |
| 1,420,950 | 6/1922 | Elder | 144/193 B |
| 1,457,966 | 6/1923 | Eastman | 144/193 R |
| 1,701,001 | 2/1929 | Hampton | 144/193 B |
| 1,803,902 | 5/1931 | Grupe | 144/193 R |
| 4,239,198 | 12/1980 | Trupp | 144/193 K |
| 4,246,941 | 1/1981 | Campbell | 144/193 B |

*Primary Examiner*—W. D. Bray
*Assistant Examiner*—W. D. Bray
*Attorney, Agent, or Firm*—Harvey B. Jacobson

[57] ABSTRACT

A mechanical wood splitter comprises a weighted cutter which is raised on a support column by means of a winch and cable drive, and then allowed to drop, in order to split a log of wood positioned thereunder into segments, by uncoupling the winch drum from a drive shaft through a clutch mechanism. The cutter has a cruciform blade arrangement and can be rotated through 45° so that, a log may be split into four segments using a single pass of the cutter or into eight segments using a double pass and rotating the cutter blades between the passes. The apparatus further includes a resilient log gripping assembly for positioning the log under the cutter and accommodating the impact of the cutter with consequential expansion of the log.

14 Claims, 8 Drawing Figures

MECHANICAL WOOD SPLITTER

BACKGROUND OF THE INVENTION

This invention relates to a mechanical wood splitter for cutting logs longitudinally into segments.

Included among objects of the invention is the provision of a mechanical log splitter having one or more of the following features, namely; the ability to utilize a variety of power sources such as an electric motor, an internal combustion engine, or a power take-off from a tractor or the like; the utilization of gravity rather than hydraulic pressure to exert force upon a log by means of a falling weight cutter which splits a log with the log oriented in the vertical rather than the horizontal so as to facilitate handling of logs; the facility for varying the number of segments into which a log can be split; the ability for an operator to effectively and safety control the operation of the splitter; and the facility for readily transporting the splitter from one location to another.

Statement of Prior Art

The following U.S. patents pertain to wood cutting apparatus and the like. However, none of these is believed to disclose an apparatus having the features of the present invention:

| | | |
|---|---|---|
| 246,122 | C. E. Grandy | Aug. 23, 1881 |
| 984,412 | R. L. Andrews | Feb. 14, 1911 |
| 1,307,714 | L. M. Van Slyke | June 24, 1919 |
| 1,420,950 | J. E. Elder | June 27, 1922 |
| 1,425,298 | A. R. Treat | Aug. 8, 1922 |
| 4,246,941 | A. C. Campbell | Jan. 27, 1981 |

SUMMARY OF THE INVENTION

A mechanical wood splitter in accordance with the invention includes a weighted cutter reciprocably carried on a vertical post or column, a winch and cable system for lifting the cutter on the column, and a winch drive including a clutch for releasing the winch drum when the cutter has been drawn up the column to a desired height, allowing the cutter to fall under gravity while paying cable out from the winch drum with only the inertia of the drum and cable resisting the free fall of the cutter. The winch drive may further include engageable and disengageable friction rollers, one of which is connected with the power source and the other of which drives the clutch, the other of said rollers, in accordance with a preferred feature of the invention, preferably comprising a resilient tire-covered member such as a conventional vehicle wheel and tire assembly useful in providing a degree of "give" in the drive train in the event of an excessive power supply or loss of control. Engagement and disengagement of the clutch and rollers may be controlled independently by an operator through separate control levers, foot pedals and the like, and the resilient roller member may also be provided with a hydraulic brake for holding the cutter in an elevated position when the clutch is engaged.

In accordance with a further feature of the invention, the wood splitter may be provided with generally arcuate log-holding arms for supporting a log under the cutter while it is being split, the arms being opened and closed manually by an operating linkage in an adjustable manner to accommodate different size logs and having a degree of resilience to accommodate expansion forces applied thereto when the log is impacted by the falling cutter.

A still further feature of the invention resides in a cutter construction comprising a cutter having blades preferably of cruciform shape rotatably carried on the base of a weighted drum or the like, whereby a log may be split into a number of segments conforming to the number of blades by a single pass of the cutter, or, if required, may be cut into double the number of segments by using a double pass of the cutter and suitably rotating the blades relative to the cutter drum between the passes.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
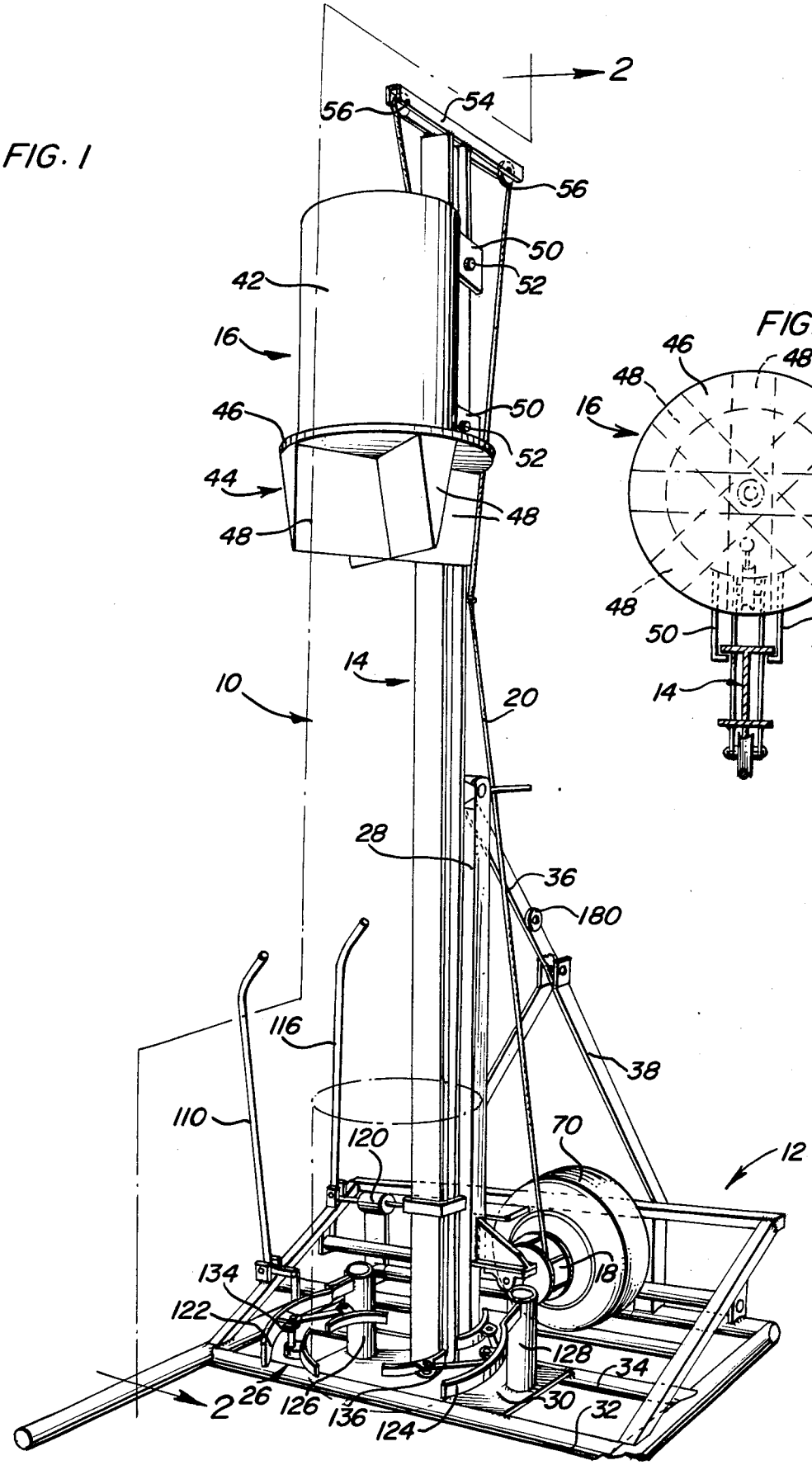
FIG. 1 is a perspective view of a mechanical wood splitter in accordance with the invention.

The illustrated wood splitter 10 comprises generally a frame 12 supporting a cutter guide column 14, a weighted cutter assembly 16 guided for vertical movement along the column, a winch system including a winch drum 18 and a cable 20 for lifting the cutter assembly up the column, a drive system for the winch including a clutch 24 for releasing the winch drum and allowing the cutter assembly to drop when the assembly has been raised to a suitable log-splitting height, and a log gripping mechanism 26 for supporting a log to be split in vertically oriented position under the cutter assembly.

Support frame 12 may be fabricated of 2-inch pipe, for example, and includes a support structure for column 14 including a vertical beam 28 welded to a base plate 30 which is secured to cross members 32, 34 of the frame, and an inclined brace 36 secured between beam 28 and a 3-point hitch structure 38 at one end of the frame. Column 14 may include brackets 40 (FIG. 2) whereby the column is pivotally connected to beam 28 for movement of the column between an upright working position shown in solid lines in the drawings, and a generally horizontal transporting position shown dotted in FIG. 2. Releasable clamps (not shown) may be provided for clamping the column in the upright position. Column 14 may, for example, comprise a 6″×6″ I-beam and it may be winched between the respective positions as will be described.

Figure 7:
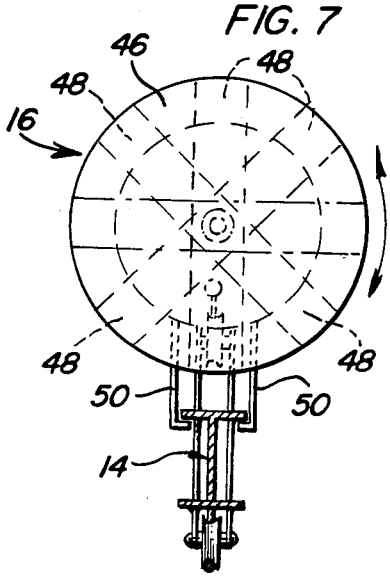
FIG. 7 is a plan view of the weighted cutter and associated elements of the splitter.

Cutter assembly 16 comprises a weight drum 42 which may, for example, be formed from 12-inch pipe, and a rotatable cutter 44 on the base of the drum. Drum 42 may be filled with suitable ballast material having a weight of the order of 400 lbs. Cutter 44 may comprise a mounting plate 46 and four radial blades 48 disposed in cruciform orientation on the mounting plate. Plate 46 may be attached to the base of drum 42 by any suitable means which allows rotation of the blades relative to the drum. For example, the assembly may include detent means facilitating rotary indexing movements of the blades between two mutually displaced positions as indicated in FIG. 7, wherein the blades are displaced by 45°. The purpose of the blade displacement facility is to allow logs to be split into a basic number of four segments using only a single pass of the cutter, or into eight segments by using a double pass of the cutter and rotating the blades 45° between the passes.

Figure 3:
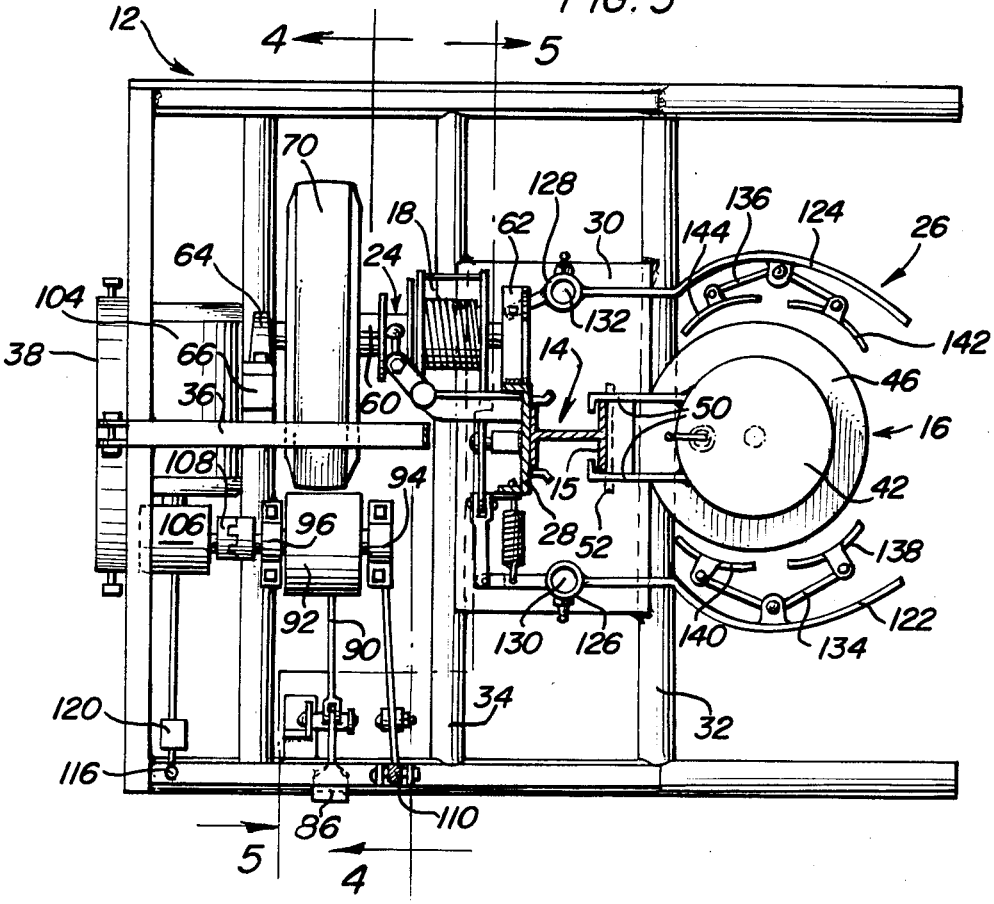
FIG. 3 is a sectional view on line 3—3 of FIG. 2.

The cutter assembly 16 is supported on column 14 by angled guides 50 welded to drum 42 and embracing outer flange 15 of the column, with stabilizing rods 52 (FIG. 3) connected between the guides. At the top of column 14 a cross beam 54 supports a pair of guide pulleys 56 for cable 20 which is attached to drum 42 by means of a suitable I-bolt 58 or the like.

Figure 6:
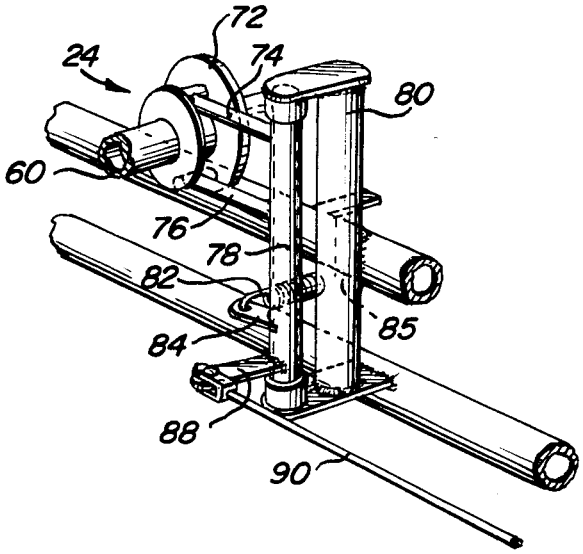
FIG. 6 is a perspective view on an enlarged scale of part of a clutch and clutch-operating mechanism used in the wood splitter.

Winch drum 18 is rotatably carried on a shaft 60 supported between bearings 62, 64 mounted respectively on beam 28 and on a further frame member 66. Also carried on shaft 60 is the clutch member 24 which is free to move along the shaft but constrained to rotate with the shaft, (e.g. the clutch may be mounted on a spline portion of the shaft or the like) and a resilient driven roller 70 also constrained to rotate with the shaft. Roller 70 may, for example, comprise a conventional vehicle wheel and tire. Clutch member 24 is a conventional bobbin shape having a clutch disc 72 at one side formed as one disc of a conventional jaw-type clutch, the other disc of which comprises one face of the winch drum 18. Accordingly, when the clutch is engaged, the winch drum is in driven engagement with shaft 60, and when the clutch is disengaged, the winch drum is free to rotate on the shaft. The clutch member is biased into engagement with the winch drum by means of a clutch operating mechanism (see particularly FIG. 6) comprising upper and lower clutch levers 74, 76 carried on a pivotal sleeve 78 journaled in a bracket assembly 80 suitably secured on frame 12. A coil spring 82 connected between an arm 84 on sleeve 78 and a frame member 85 biases the sleeve and clutch levers to engage the clutch, and the clutch can be disengaged by a foot pedal 86 (FIG. 3) connected to an arm 88 on sleeve 78 through a linkage 90. Thus, when the foot pedal is depressed, sleeve 78 is rotated aginst the action of spring 82 to release the clutch and allow the winch drum to rotate freely, and when the foot pedal is released, spring 82 reengages the clutch thereby drivingly connecting the winch drum to shaft 60.

Shaft 60 is rotated by means of a drive roller 92 which can be moved into and out of engagement with the periphery of rotor 70. In the illustrated embodiment, drive roller 92 is supported between bearings 94, 96 mounted on brackets 98, carried by a rocking shaft 102 suitably supported on the frame, roller 92 being rotated by an electric motor 104 through a suitable gearbox 106 and coupling 108, the motor and gearbox being supported for rocking movements with shaft 102. (The motor drive is only shown by way of example, and other power sources such as an IC engine or a power take-off from a tractor or the like can be used to drive roller 92).

Figure 4:
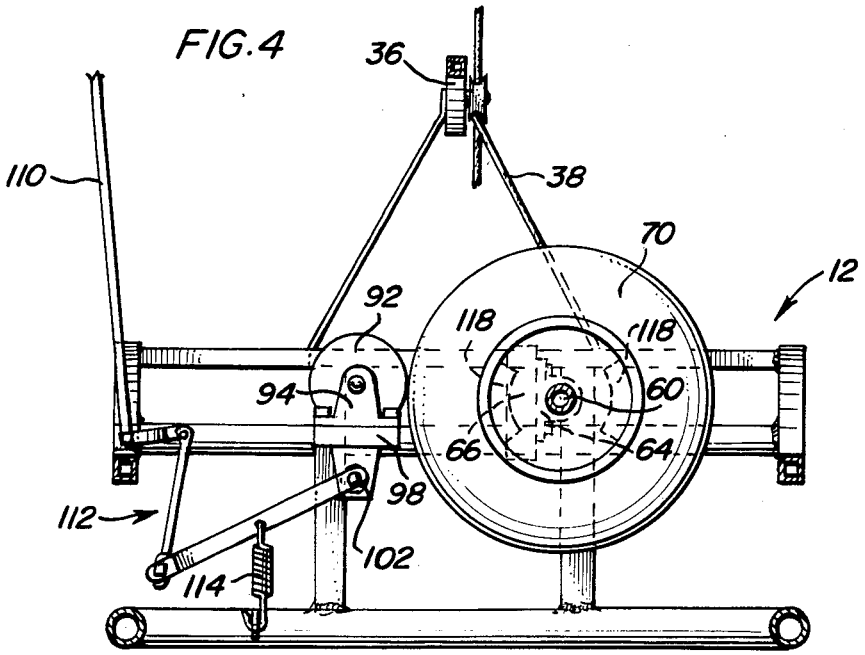
FIG. 4 is a sectional view on line 4—4 of FIG. 3.

Rocking of shaft 102 to bring drive roller 92 into an out of engagement with driven roller 70 is effected by means of a first hand lever 110 through a linkage 112 (see FIG. 4 in particular), a spring 114 serving to bias the drive roller toward a position in which it is out of engagement with driven roller 70.

A second hand lever 116 is provided for operating a hydraulic brake 118 for roller 70 (the brake being shown diagrammatically in FIG. 4) through a master cylinder 120. When brake 118, which may be of conventional design, is applied, roller 70, along with shaft 60 and winch drum 18 (provided the clutch is in engagement) are held stationary.

Figure 5:
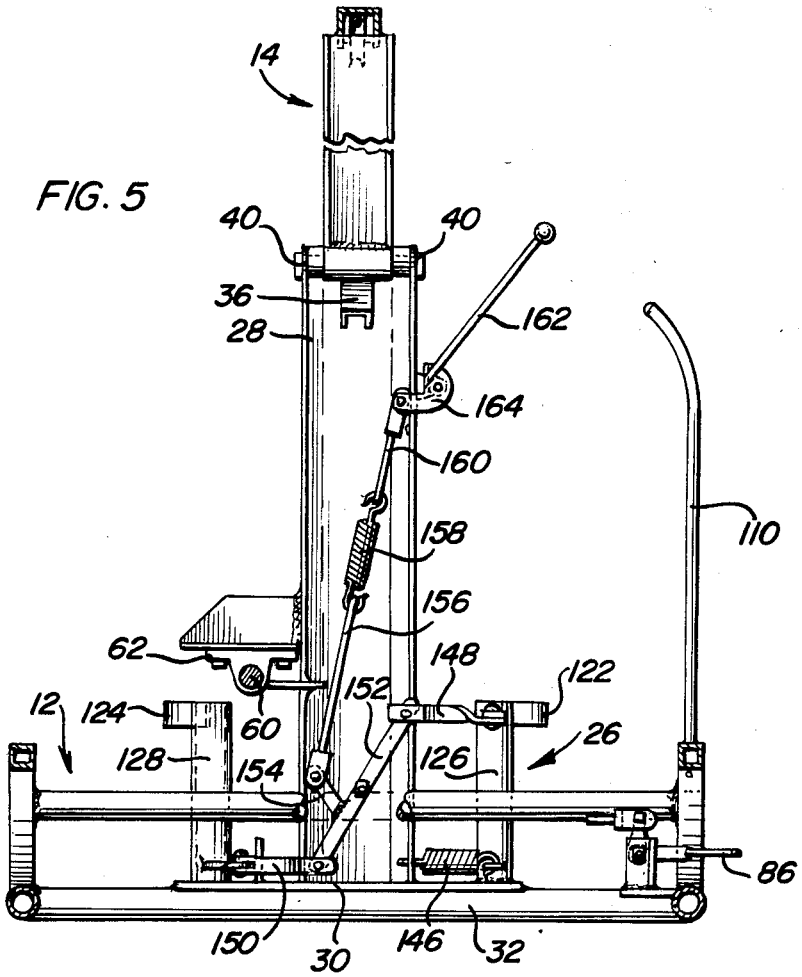
FIG. 5 is a sectional view on line 5—5 of FIG. 3.

Log gripping mechanism 26 comprises a pair of arcuate arms 122, 124 carried on respective sleeves 126, 128 journaled on upright posts 130, 132, respectively. The arcuate arms carry respective internal pivoted Y-shaped rods 134, 136 with pivoted log-gripping arcuate plates 138, 140, 142, 144 (FIG. 3) at their respective ends. Sleeve 126 is biased in a direction urging arm 122 outwardly by means of a spring 146 (see FIG. 5) connected between the sleeve and beam 28. Further, the journals are connected for movement in unison by a linkage including links 148 and 150 pivoted to a common central link 152 having an arm 154 attached to a rod 156. The rod 156 is secured by means of a spring 158 to a further rod 160 connectd to an operating handle 162 via a pivotal toggle link 164 carried on beam 28. The action of spring 146 is to bias the arcuate log gripping arms outwardly, but these may be moved inwardly by means of handle 162 to grip against logs of various diameter through the flexibility obtained by spring 158 and the toggle linkage. Further, the resilience afforded by spring 146 along with the pivoted Y-shaped arms 134, 136 allows the gripping mechanism to accommodate impact forces creating expansion of log when it is impacted by the cutter assembly, and the Y-shaped arms and pivotal end plates accommodate circumferential variations and misalignments in the log itself.

Figure 8:
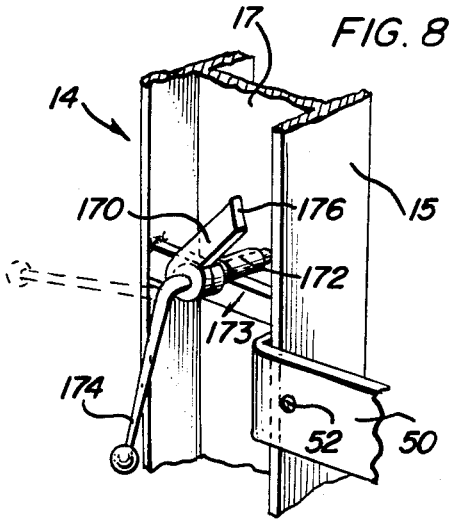
FIG. 8 is a perspective view of a part of the cutter guide column showing a cutter locking device.

A knock-off locking mechanism as shown in FIG. 8 is provided for the cutter assembly. The mechanism comprises a pivoted latch member 170 journaled on a pin 172 carried at a convenient location on column 14 between its web 17 and a mounting plate 173, the latch member being controlled by an operating handle 174. The latch has an inclined forward surface 176 which, is adapted to engage the interior of one of the beam flanges 15 when the latch is manually placed into horizontal position by means of handle 174. In this condition of the latch, when one of the guides 50 of the cutter assembly is above the latch, the latch prevents downward movement of the cutter assembly by arresting the cutter guide since the latch member will be jammed against the flange 15. However, the configuration of the latch when in the horizontal position allows the cutter assembly to be raised, if it is below the latch, by a pivotal, knock-off action with the cutter guide moving the latch away from the horizontal position.

In operation of the wood splitter, initially the cutter assembly is raised up column 14 by engaging the drive train through movement of roller 92 into engagement with the periphery of roller 70 using the hand lever 110. When the cutter assembly has been raised to a position in which upper guide 50 is just above latch 170, brake 118 is applied through lever 116 arresting upward movement of the cutter and the drive rollers are disengaged using lever 110. Latch 170 serves as a safety device preventing the cutter from descending. A log may then be positioned between arms 122 and 124, and the arms are brought into gripping engagement with the log by means of the handle 162. Then, the cutter assembly may be lifted to a suitable log-splitting height by reengaging the drive rollers using lever 110 and disengaging the brake. In this movement, the lower cutter guide will move latch 170 away from the horizontal engaged position thereby releasing the locking mechanism.

When the cutter has been raised to a suitable log splitting height, the pedal 86 may be depressed to disengage the clutch and release the winch drum 18 from drive shaft 60. Accordingly, the weighted cutter will drop and impact the log to split same into four segments paying out cable from the winch drum and rotating the winch drum on shaft 60, so that descent of the cutter is resisted substantially only by the inertia of the winch drum and cable. At this point in the operation, the drive rollers will again be disengaged using hand lever 110.

After the log has been split into four segments, the cutter assembly may again be raised to just above the latch 170 as previously described, and the latch reengaged. If only four segments are required in the split log, the log may then be replaced by another log and the cycle repeated. Alternatively, if it is required to split the log into eight segments, the cutter blades may be rotated through 45 degrees as previously described and the cycle may then be repeated on the same log.

Figure 2:
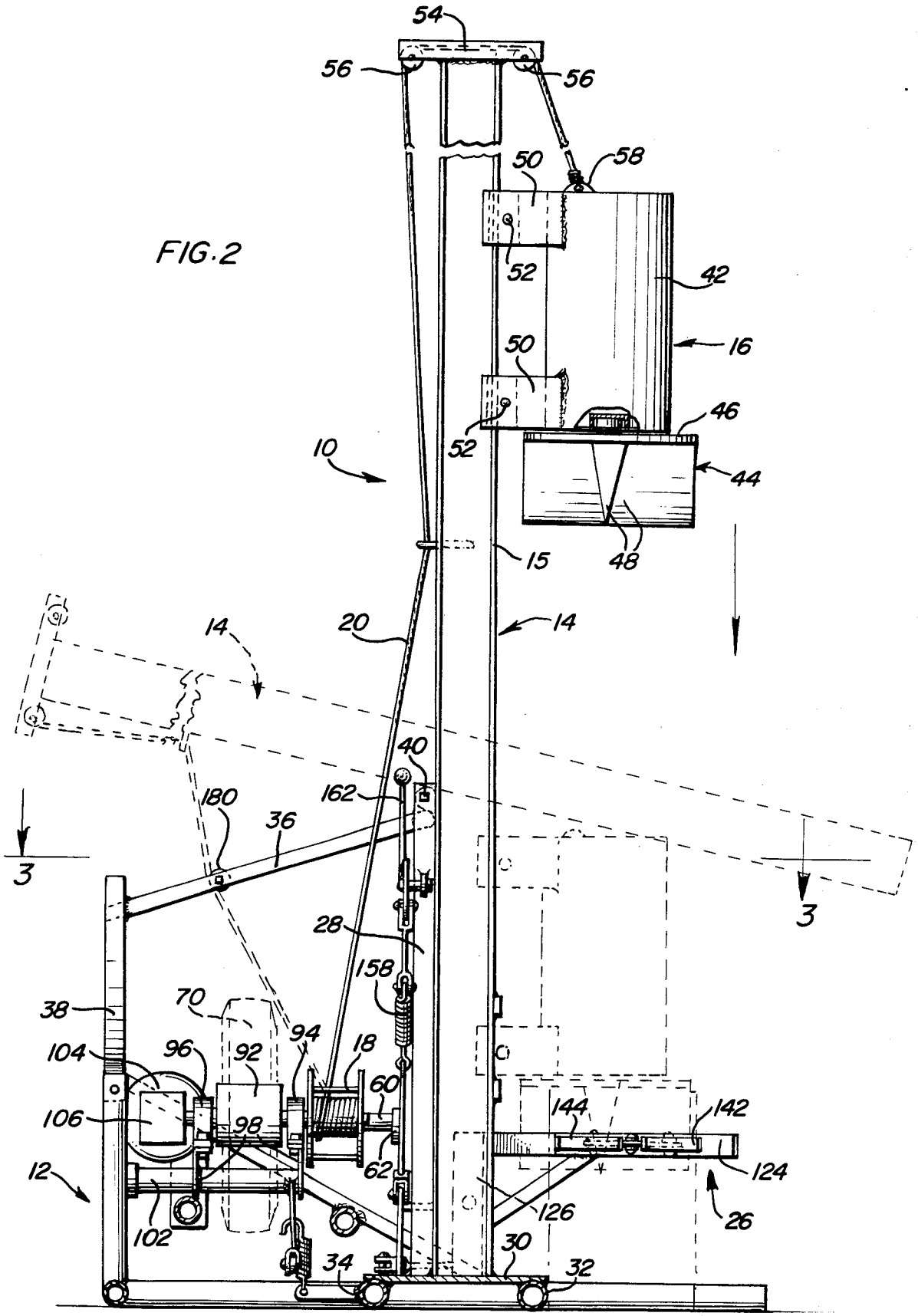
FIG. 2 is a sectional view on line 2—2 of FIG. 1.

For transportation of the cutter, column 14 with the cutter assembly thereon may be winched into the horizontal dotted line position shown in FIG. 2 by placing cables 20 over an idler roller 180 secured to beam 36 winding the cables in on the winch drum by operation of the winch as previously described.

The foregoing is considered as illustrative only of the principles of the invention. Further, since numerous modifications and changes will readily occur to those skilled in the art, it is not deired to limit the invention to the exact construction and operation shown and described, and accordingly, all suitable modifications and equivalents may be resorted to, falling within the scope of the invention.

What is claimed as new is as follows:

1. A mechanical wood splitter comprising a weighted cutter assembly, a guide column for the cutter assembly, means for supporting the column in a vertical orientation, means mounting the cutter assembly for reciprocal vertical movement along the column, a winch drum and cable for lifting the cutter assembly on the column, and a winch drive for the winch drum including a clutch for releasing the winch drum when the cutter has been drawn up the column to a desired log-splitting height allowing the cutter to fall under gravity while paying out cable from the winch drum so as to impact and split a log positioned under the cutter assembly with substantially only the inertia of the winch drum and cable resisting free fall of the cutter assembly, wherein the winch drive includes engageable and disengageable drive and driven rollers, the driven roller being mounted on a shaft carrying the clutch and winch drum, the drive roller being mounted for connection to a power source and for movement into and out of engagement with the driven roller.

2. The invention of claim 1 wherein the drive roller is mounted on a rocking shaft movable by means of a hand lever for moving the drive roller into and out of engagement with the driven roller.

3. The invention of claim 1 wherein the driven roller has a resilient surface.

4. The invention of claim 3 wherein the driven roller comprises a wheel and tire assembly.

5. The invention of claim 1 wherein the winch drum is rotatably mounted on the shaft and the clutch comprises a clutch member constrained to rotate with the shaft and capable of movement along the shaft, a first clutch disc associated with the winch drum, a second clutch disc associated with said clutch member, and a clutch-operating mechanism or moving the clutch member along the shaft to engage and disengage the clutch disc.

6. The invention of claim 5 wherein the clutch-operating mechanism includes biasing means for urging the clutch member to engage the clutch disc, and a foot pedal-operated linkage for moving the clutch member to disengage the clutch discs.

7. A mechanical wood splitter comprising a weighted cutter assembly, a guide column for the cutter assembly, means for supporting the column in a vertical orientation means mounting the cutter assembly for reciprocal vertical movement along the column, means for raising the cutter assembly up the column and allowing same to drop from a suitable wood-splitting height onto a log located beneath the cutter assembly, and log gripping means for holding a log in a vertical orientation under the cutter assembly, the gripping means comprising a pair of arcuate log-gripping arms, means mounting the arms for pivotal movement about vertical axes into and out of engagement with a log, manually operated control means for moving the arms about said axes including resilient means for accommodating expansive forces on a log when gripped by the arms and impacted by the cutter assembly.

8. The invention of claim 2 wherein the control means comprises a mechanical linkage connecting said arms for movement in unison and a manual operating lever connected to said linkage by a toggle mechanism for holding the arms in gripping engagement with a log, the resilient means, comprising a spring means connected in said linkage.

9. The invention of claim 8 including biasing means urging said arms out of gripping engagement with the log, the control means overcoming the biasing means to provide gripping movement of the arms unto a log.

10. The invention of claim 7 wherein each arm includes means for compensating for irregularities is log profile and the like when gripping a lop.

11. The invention of claim 10 wherein the compensating means comprises aan elongate concave member pivotally mounted on the interior of each of said arms.

12. The invention of claim 11 including log-engaging plates pivotally connected at the extremities of each concave member.

13. A mechanical wood splitter comprising a weighted cutter assembly, a guide column for the cutter assembly, means for supporting the column in a vertical orientation, means mounting the cutter assembly for reciprocal movement along the column, and means for raising the cutter assembly up the column and allowing same to drop from a suitable wood-splitting height onto a log located beneath the cutter assembly, wherein the cutter assembly comprises a weight drum and a bladed cutter rotatably mounted on the bottom of the weight drum whereby the orientation of the cutter blades may be altered in relation to a log being split by rotation of the cutter relative to the drum so as to split the log into a number of sections in excess of the number of cutter blades by multiple passes of the cutter assembly and rotational adjustment of the cutter between the passes, including a log gripping mechanism below the cutter assembly comprising a pair of arcuate log gripping arms pivotally mounted for movement into and out of log gripping engagement, a manually operated linkage for pivoting the arms in unison into log gripping engagement and retaining the arms in log gripping engagement by a toggle action, the log gripping mechanism including means for accommodating impact forces of the cutter assembly on a log being split and means compensating for irregularities in log profile and the like.

14. A mechanical wood splitter comprising a weighted cutter assembly, a guide column for the cutter assembly, means for supporting the column in a vertical orientation, means mounting the cutter assembly for reciprocal movement along the column, and means for raising the cutter assembly up the column and allowing same to drop from a suitable wood-splitting height onto a log located beneath the cutter assembly, wherein the cutter assembly comprises a weight drum and a bladed cutter rotatably mounted on the bottom of the weight drum whereby the orientation of the cutter blades may be altered in relation to a log being split by rotation of the cutter relative to the drum so as to split the log into a number of sections in excess of the number of cutter blades by multiple passes of the cutter assembly and rotational adjustment of the cutter between the passes wherein the means for raising the cutter assembly up the column and allowing same to drop from a suitable log splitting height comprises a winch and cable system for pulling the cutter assembly up the column including a winch drum and clutch mechanism for releasing the winch drum as required and allowing the cutter assembly to drop under gravity resisted substantially only by the inertia of the winch drum and cable wherein the column is mounted on a frame means for pivotal movement to a substantially horizontal transporting position under control of the winch and cable system.

* * * * *